US010703110B2

(12) United States Patent
Aoki et al.

(10) Patent No.: US 10,703,110 B2
(45) Date of Patent: Jul. 7, 2020

(54) LIQUID HOLDING CONTAINER AND RECORDING APPARATUS

(71) Applicant: CANON KABUSHIKI KAISHA, Tokyo (JP)

(72) Inventors: Noriyuki Aoki, Tokyo (JP); Masakazu Nagashima, Yokohama (JP); Ryohei Maruyama, Kawasaki (JP); Toshiaki Yamaguchi, Machida (JP); Naoaki Wada, Yokohama (JP); Tomohito Abe, Yokohama (JP); Daigo Kuronuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 16/244,675

(22) Filed: Jan. 10, 2019

(65) Prior Publication Data

US 2019/0232677 A1 Aug. 1, 2019

(30) Foreign Application Priority Data

Jan. 31, 2018 (JP) ..... 2018-014555

(51) Int. Cl.
*B41J 2/185* (2006.01)
*B41J 2/165* (2006.01)
*B41J 2/175* (2006.01)

(52) U.S. Cl.
CPC ..... *B41J 2/185* (2013.01); *B41J 2/16508* (2013.01); *B41J 2/16523* (2013.01); *B41J 2/17509* (2013.01); *B41J 2002/1856* (2013.01)

(58) Field of Classification Search
CPC .... B41J 2/185; B41J 2/17509; B41J 2/16508; B41J 2/16523; B41J 2002/1856
See application file for complete search history.

(56) References Cited

U.S. PATENT DOCUMENTS

2007/0076046 A1* 4/2007 Toki ..... B41J 2/185 347/31

FOREIGN PATENT DOCUMENTS

JP 2005-131945 A 5/2005

* cited by examiner

*Primary Examiner* — Bradley W Thies
(74) *Attorney, Agent, or Firm* — Canon U.S.A., Inc. IP Division

(57) ABSTRACT

A liquid holding container includes a top face portion having an opening portion, a bottom face portion facing the top face portion, a first ink absorber being disposed near the opening portion and layered in a first direction from the bottom face portion to the top face portion, the first ink absorber being configured to absorb a liquid introduced from the opening portion, and a second ink absorber being disposed outside the first absorber in a second direction that intersects the first direction and layered in the second direction, the second ink absorber being configured to absorb the liquid moving from the first ink absorber.

13 Claims, 7 Drawing Sheets

LIQUID HOLDING CONTAINER AND RECORDING APPARATUS

BACKGROUND OF THE DISCLOSURE

Field of the Disclosure

The disclosure relates to a liquid holding container that contains and holds a liquid, and to a recording apparatus.

Description of the Related Art

Conventionally, among business-use inkjet printers for a large amount of printing and inkjet printers for a large-scale printed material such as a poster, there has been a printer that includes a detachable liquid holding container that contains and holds waste ink. The waste ink results from operation such as cleaning operation for inhibiting an ejection failure of a recording head. The amount of the waste ink increases with the printing operation time. To address such an increase, an absorber such as felt is provided inside the liquid holding container. The absorber absorbs the waste ink and holds the absorbed waste ink.

Japanese Patent Application Laid-Open No. 2005-131945 discusses a liquid holding container that has a container unit and a cover unit. The container unit is shaped like a box. The container unit has an opening in an upper portion, and contains an absorber. The cover unit is attached to cover the opening of the container unit, and has an opening portion for introducing a liquid into the container unit. The absorber is made of a sheet-shaped member such as felt having ink absorbency. The absorber is configured to be laminated from a bottom face portion to a top face portion (the cover unit) of the liquid holding container. The absorber has a shape and a size that substantially match with an inner surface of the liquid holding container to be in contact with a side face portion of the liquid holding container without creating clearance.

In the liquid holding container discussed in Japanese Patent Application Laid-Open No. 2005-131945, the absorber made of felt absorbs the ink by utilizing a strong capillary action of fiber, and holds the ink against gravity. However, in a case where a large height difference is caused in the absorber, such as a case where the liquid holding container is tilted, for example, 90 degrees, the capillary action becomes weaker as the height of a liquid surface becomes higher. Thus, a balance with gravity is lost, and the ink held by the absorber falls due to gravity. As a result, the ink seeping from the absorber may leak from the clearance between the container unit and the cover unit.

SUMMARY OF THE DISCLOSURE

The disclosure is directed to a liquid holding container that inhibits leakage of liquid from inside even in a tilted state.

According to an aspect of the disclosure, a liquid holding container includes a top face portion having an opening portion, a bottom face portion facing the top face portion, a first ink absorber being disposed near the opening portion and layered in a first direction from the bottom face portion to the top face portion, the first ink absorber being configured to absorb a liquid introduced from the opening portion, and a second ink absorber being disposed outside the first absorber in a second direction that intersects the first direction and layered in the second direction, the second ink absorber being configured to absorb the liquid moving from the first ink absorber.

In such a liquid holding container, the first absorber is disposed near the opening portion, and the second absorber configured to be layered is provided outside the first absorber. Therefore, even in a case where the liquid holding container is vertically tilted, ink that cannot be held by the first absorber and thus can seep from the first absorber can be held by the second absorber. Accordingly, leakage of e ink to the outside of the liquid holding container can be inhibited.

Further features and aspects of the disclosure will become apparent from the following description of example embodiments with reference to the attached drawings.

DESCRIPTION OF THE EMBODIMENTS

Example embodiments of the disclosure and various aspects thereof will be described below with reference to the drawings. Portions identical or corresponding to each other are provided with the same sign.

Figure 1:
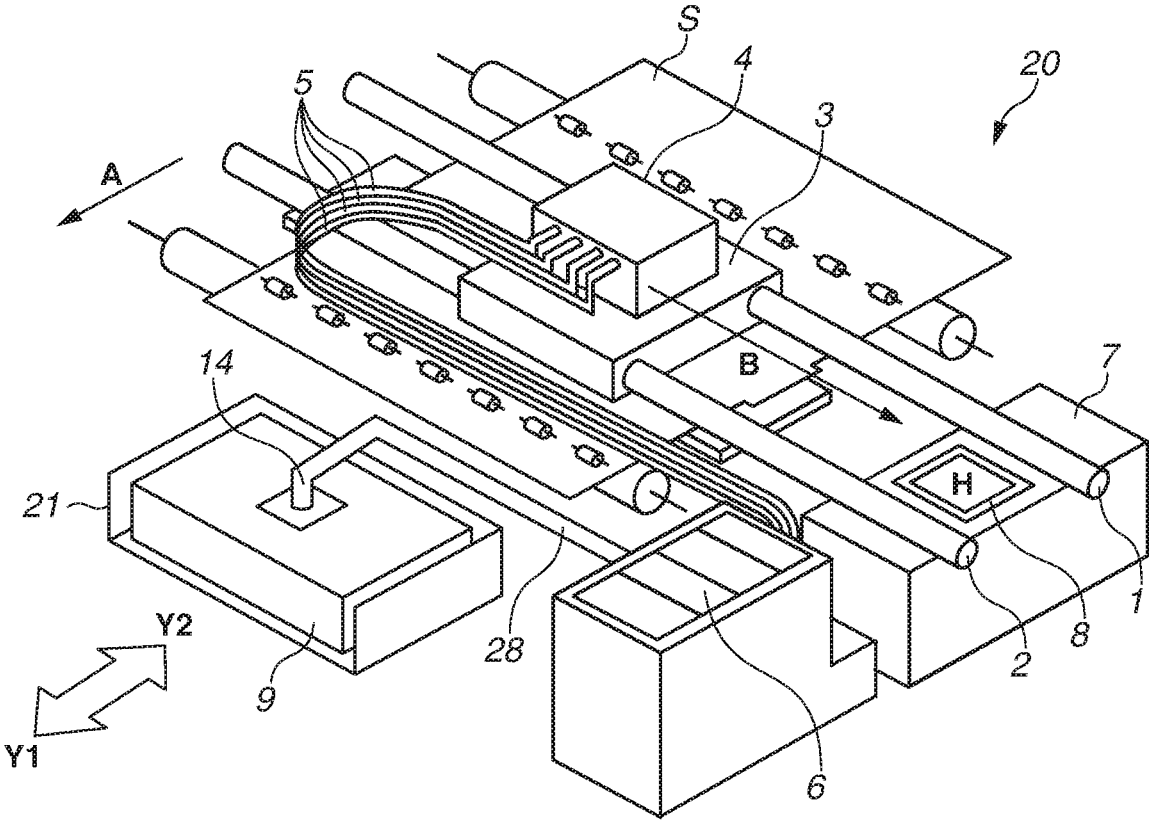
FIG. 1 is a schematic perspective view illustrating an example configuration of an inkjet recording apparatus.

FIG. 1 is a schematic perspective view illustrating a configuration of an inkjet recording apparatus (hereinafter may also be simply referred to as "recording apparatus") to which a liquid holding container according to an example embodiment of the disclosure is applied.

A recording apparatus 20 includes a guide rail 1, a sub-rail 2 provided parallel to the guide rail 1, and a carriage 3 mounted on the guide rail 1. The carriage 3 is provided with a recording head 4 that discharges ink. The recording head 4 is connected to an ink tank 6 via liquid supply tubes 5. The ink tank 6 contains ink to be supplied to the recording head 4. The carriage 3, which is guided by the guide rail 1 and the sub-rail 2, moves in an arrow B direction, and the recording head 4 discharges inks of different colors, and thus an image is recorded on a recording sheet S that is conveyed in a conveyance direction A.

In the recording apparatus 20, by repeating ejections of the liquid, heat is generated and thus produces air bubbles in the ink inside the recording head 4. Since the air bubbles can cause an ejection failure, recovery operation is performed, for example, to remove the air bubbles. The recording apparatus 20 includes a recovery unit 7 and a waste liquid holding container (a liquid holding container) 9. The recovery unit 7 performs recovery operation for the recording head 4. The waste liquid holding container (the liquid holding container) 9 contains and holds waste ink that is collected from the recording head 4 by the recovery operation. The waste liquid holding container 9 is detachably attached to a frame 21. The waste liquid holding container 9 moves in an arrow Y1 direction to be detached from the frame 21, and moves in an arrow Y2 direction to be attached to the frame 21.

In the recovery operation for the recording head 4, the carriage 3 moves to a recovery operation position H, and a cap 8 seals (caps) the recording head 4. In this state, the recovery unit 7 sucks the ink inside the recording head 4 by, for example, performing suction operation using a pump mechanism (not illustrated) such as a tube pump. The sucked ink (the waste ink) is discharged from a waste ink tube 28 to the waste liquid holding container 9, by passing through a discharging unit 14. The waste liquid holding container 9 is installed immediately below the discharging unit 14.

Figure 2:
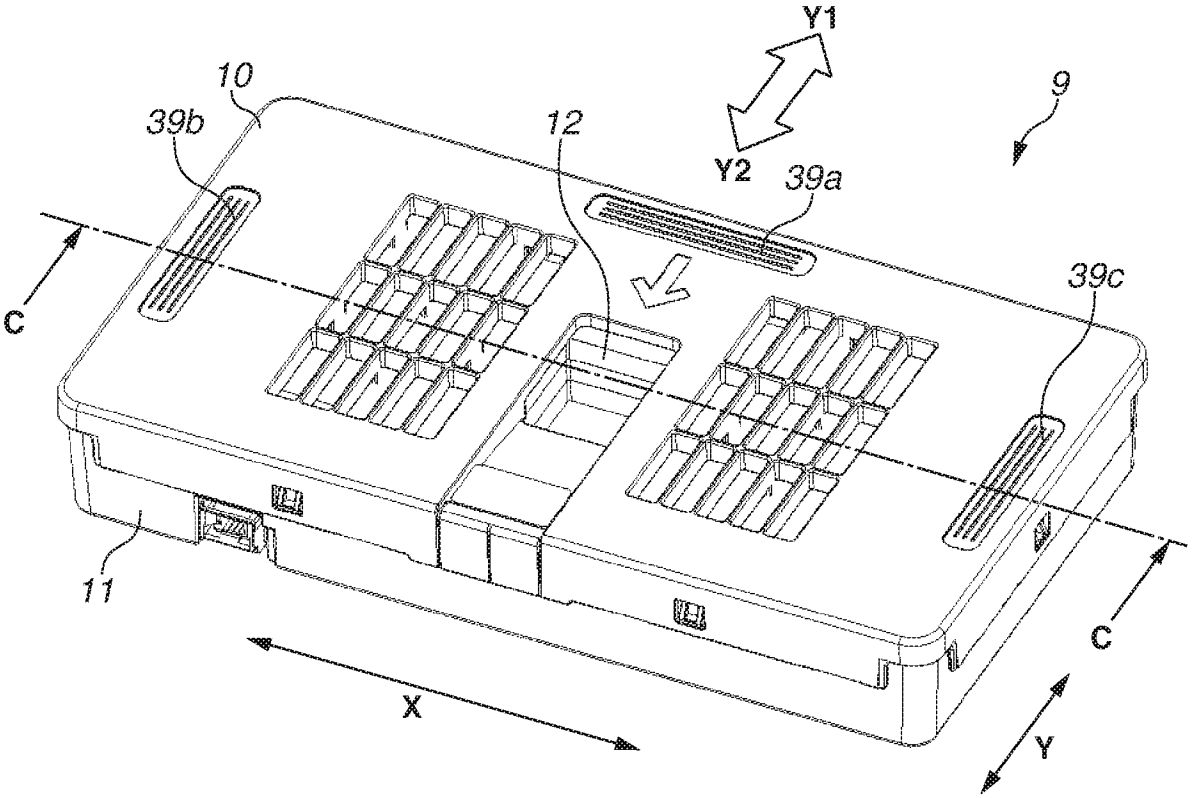
FIG. 2 is a perspective view of an example waste liquid holding container.
Figure 3:
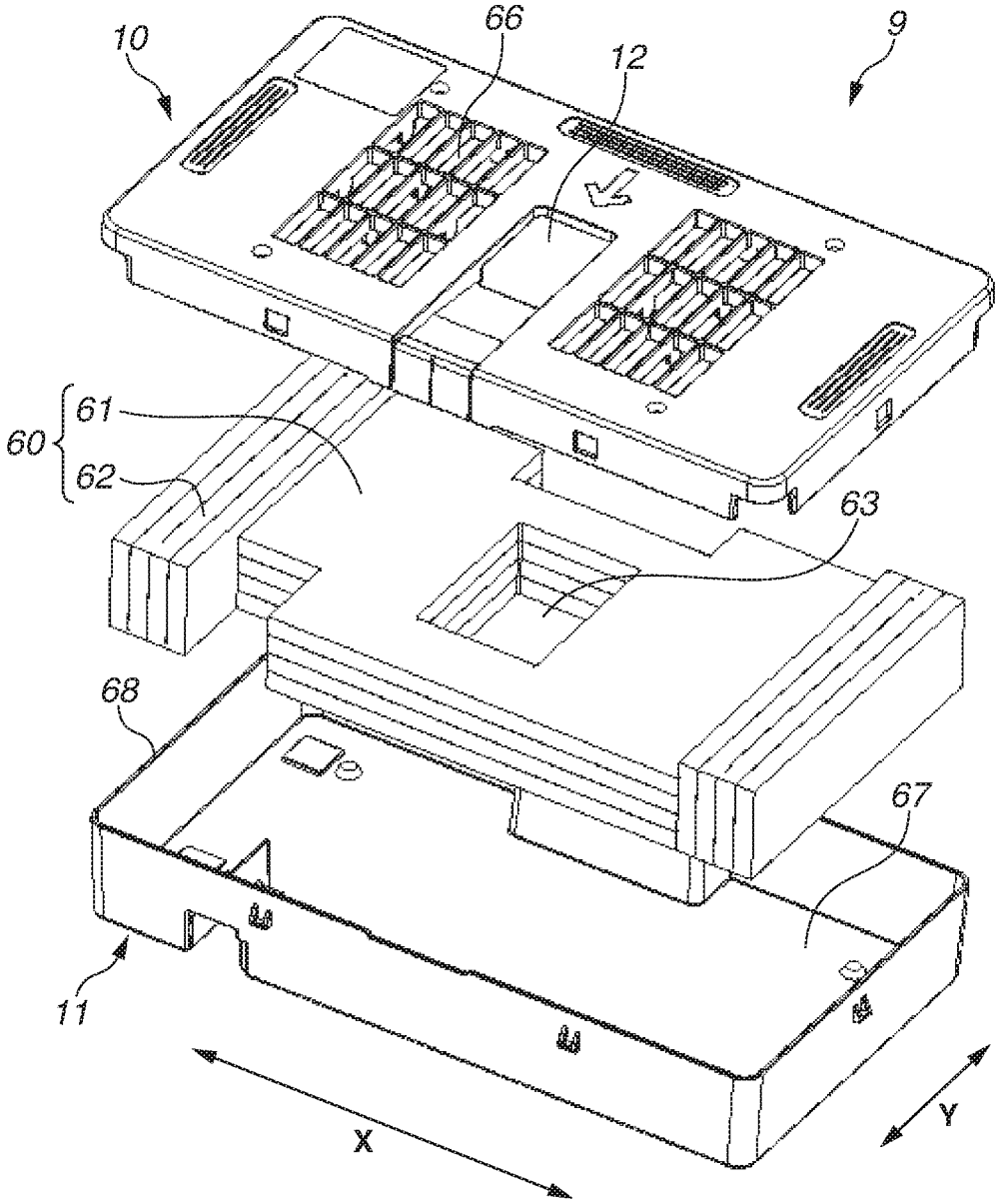
FIG. 3 is an exploded perspective view of the waste liquid holding container.

A configuration of the waste liquid holding container 9 according to the present example embodiment will be described with reference to FIG. 2 and FIG. 3. FIG. 2 and FIG. 3 are a perspective view and an exploded perspective view, respectively, of the waste liquid holding container 9 according to the present example embodiment.

The waste liquid holding container 9 includes an absorber 60, a container unit 11, and a cover unit 10, The absorber 60 absorbs a liquid. The container unit 11 is rectangular-box shaped and includes an opening in an upper portion and the absorber 60 therein. The cover unit 10 is attached to cover the opening of the container unit 11. A waste ink introduction port (an opening portion) 12 is formed in a top face portion, i.e., the cover unit 10, of the waste liquid holding container 9. The waste ink introduction port 12 is formed to introduce the waste ink from the discharging unit 14 into the container unit 11. A front surface of the cover unit 10 includes operation portions 39*a* to 39*c* indicating areas that a user can touch in attachment/detachment operation of the waste liquid holding container 9, In the present example embodiment, the waste liquid holding container 9 has such a shape that a width (a length in the arrow B direction in FIG. 1) is longer than a height and a depth so that the recording apparatus 20 can be low in height and shallow in depth. The absorber 60 is configured of a sheet-shaped member (a sheet member) such as felt having ink absorbency, Details of a configuration and a function of the absorber 60 will be described below.

The waste ink collected from the recording head 4 by the recovery operation is introduced into the waste liquid holding container 9 from the discharging unit 14 through the waste ink introduction port 12, The introduced waste ink is absorbed and held by the absorber 60, The waste ink is accumulated in the waste liquid holding container 9 and an integrated amount is measured by a waste ink counter (not illustrated) of the recording apparatus 20, When the integrated amount exceeds a predetermined amount, replacement of the waste liquid holding container 9 is notified to the user. The user detaches the waste liquid holding container 9, which is filled with the waste ink, from the frame 21, and attaches a new waste liquid holding container as a replacement.

Figure 4:
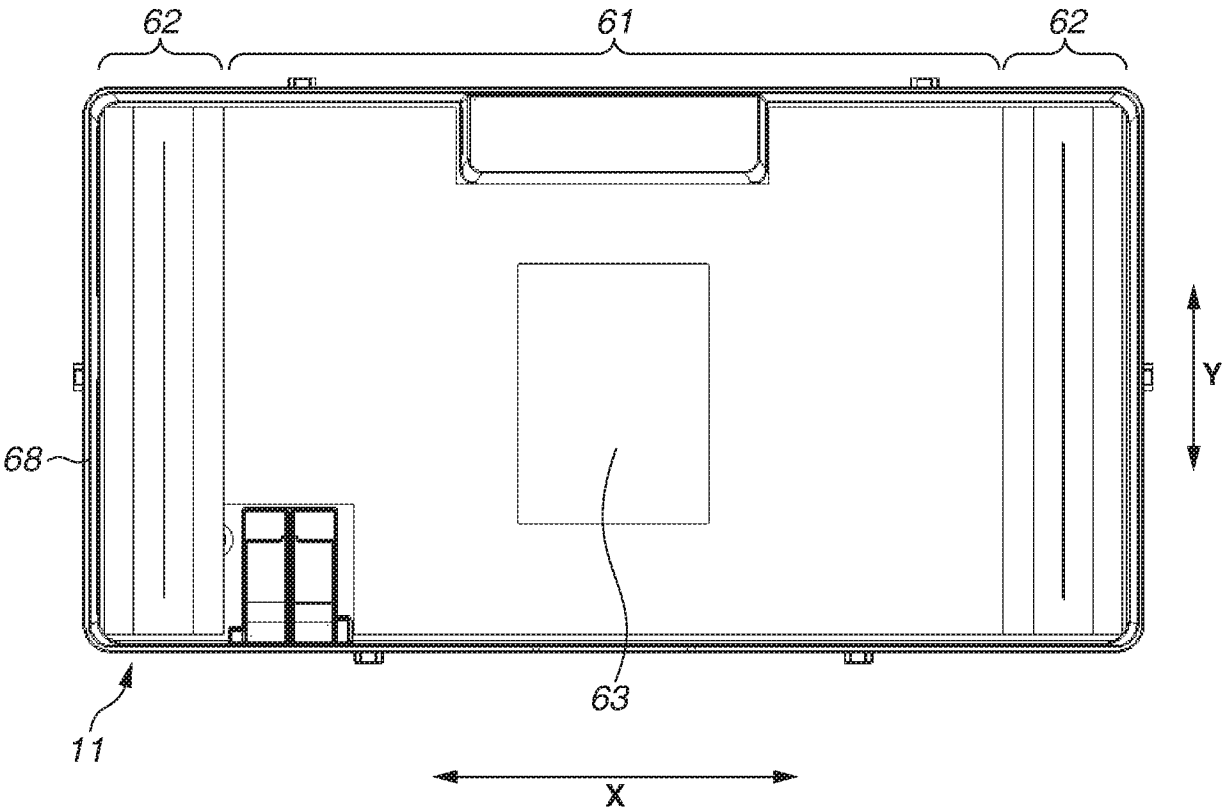
FIG. 4 is a top view illustrating a state where a cover unit of the waste liquid holding container is removed.
Figure 5:
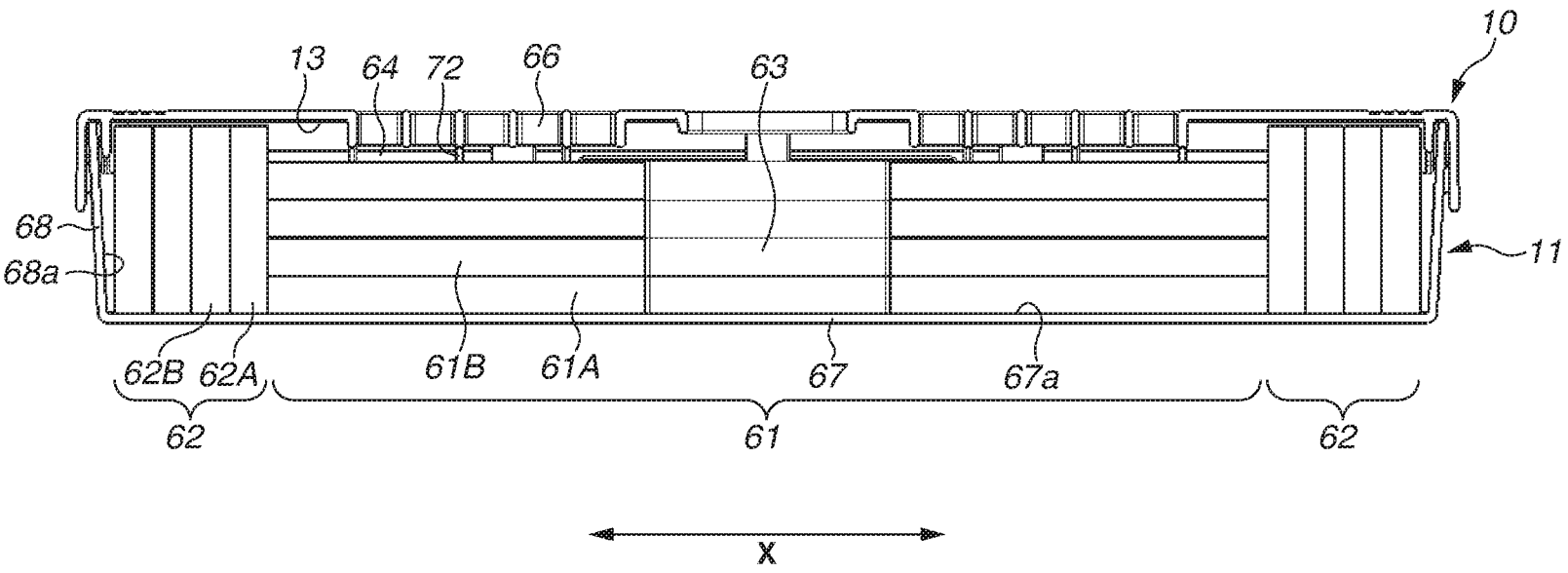
FIG. 5 is a cross-sectional diagram taken along a line C-C in FIG. 2.

Next, a configuration of the absorber used for the waste liquid holding container according to the present example embodiment will be described with reference to FIG. 3 to FIG. 5. FIG. 4 is a top view illustrating a state where the cover unit of the waste liquid holding container 9 is removed. FIG. 5 is a cross-sectional diagram taken along a line C-C in FIG. 2.

The absorber 60 includes a first absorber 61 and a second absorber 62 each made of a material having ink absorbency. The first absorber 61 is disposed near the waste ink introduction port 12 of the cover unit 10. In the present example embodiment, the first absorber 61 is made of a sheet member including a plurality of layers laminated from a bottom face portion 67 of the container unit 11 to the cover unit 10. The first absorber 61 is disposed to be in contact with the bottom face portion 67 of the container unit 11. A waste ink introduction portion (a through opening) 63 is formed in the first absorber 61. The waste ink introduction portion 63 communicates with the waste ink introduction port 12 by passing through the first absorber 61 in a lamination direction of the sheet member.

As illustrated in FIG. 3, the waste ink introduction portion 63 is a space formed by the first absorber 61 surrounding the space and the bottom face portion 67 of the container unit 11. In general, in an absorber, the absorbency of a cutting surface is higher than the absorbency of a front surface. Therefore, the first absorber 61 is not disposed immediately below the waste ink introduction port 12, and the ink introduced from the waste ink introduction port 12 is contained in the space of the waste ink introduction portion 63 once, and then absorbed by the first absorber 61. In other words, the ink is absorbed from a cutting surface of the first absorber 61 surrounding the waste ink introduction portion 63 not from a front surface of the first absorber 61. A predetermined amount of ink can be thereby contained in the waste ink introduction portion 63, even if the ink is quickly discharged from the waste ink introduction port 12. In addition, because the ink is absorbed from the cutting surface of high absorbency, the ink can be absorbed without overflowing. The waste ink introduction portion 63 may have an inner volume that can contain a predetermined amount of ink introduced from the waste ink introduction port 12. Therefore, it is also possible to adopt such a form that the first absorber 61 is laminated on the bottom face of the waste ink introduction portion 63 as well.

The second absorber 62 is disposed outside the first absorber 61, in a direction that intersects the lamination direction (a first lamination direction) of the sheet member of the first absorber 61, The second absorber 62 is configured to be layered in this intersecting direction (a second lamination direction), In the present example embodiment, the first lamination direction and the second lamination direction are orthogonal to each other. In the present example embodiment, the second absorber 62 has a layered structure in which one sheet member is folded to have a bellows-like shape. The second absorber 62 is disposed between a side face portion 68 of the container unit 11 in a longitudinal direction X of the waste liquid holding container 9 and the first absorber 61. In other words, the second absorber 62 is disposed next to the first absorber 61, in a longitudinal direction of the first absorber 61 formed to have a rectangular shape as viewed from the lamination direction of the sheet member. In the present example embodiment, a fold portion of the sheet member of the second absorber 62 faces the bottom face portion 67 of the container unit 11 and a back surface 13 of the cover unit 10. However, the fold portion may face a side face portion of the container unit 11 in a transverse direction Y of the waste liquid holding container 9. Further, a break may be formed in part to become a fold in the sheet member of the second absorber 62 to make it easy to fold the sheet member. The second absorber 62 is disposed between the first absorber 61 and the side face portion 68 of the container unit 11, while being compressed to some extent to be in contact with each of the first absorber 61 and the side face portion 68 without creating clearance. The second absorber 62 is disposed while being compressed to some extent to be also in contact with each of the bottom face portion 67 of the container unit 11 and the cover unit 10 without creating clearance.

The back surface 13 (a surface facing the absorber 60) of the cover unit 10 is provided with a rib 72 that protrudes toward the first absorber 61 and abuts the first absorber 61. The rib 72 is provided to form a space 64 between the cover unit 10 and the first absorber 61, while compressing the first absorber 61 in the lamination direction. A vent (a hole portion) 66 that communicates with the inside of the waste liquid holding container 9 is formed in an area facing the first absorber 61 of the cover unit 10, The first absorber 61 is exposed to the outside (atmosphere) by the space 64 and the vent 66. Thus, evaporation of the waste ink held by the first absorber 61 is accelerated, so that the first absorber 61 can absorb and hold the waste ink more. As a result, the amount of the waste ink to be contained in the waste liquid holding container 9 can be increased, and thereby the frequency of replacement of the waste liquid holding container 9 can be lower. On the other hand, the rib 72 and the vent 66 are not provided in a portion of the back surface 13 of the cover unit 10 that is facing the second absorber 62. In other words, the second absorber 62 is disposed to be in contact with the back surface 13 of the cover unit 10, without being exposed to the outside (atmosphere).

Figure 6:
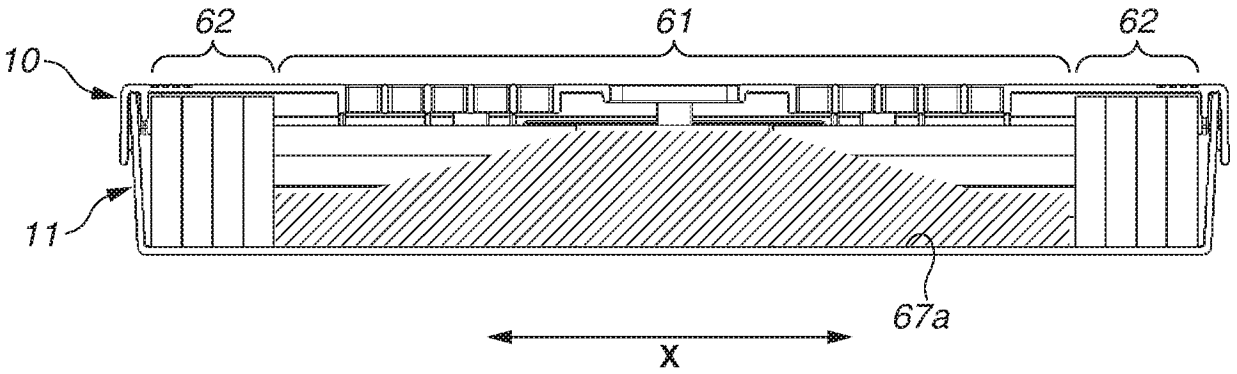
FIG. 6 is a cross-sectional diagram illustrating a state where ink is held by an absorber of the waste liquid holding container.

Next, how the waste ink introduced into the waste liquid holding container penetrates the absorber will be described with reference to FIG. 5 and FIG. 6, FIG. 6 is a cross-sectional diagram illustrating a state where ink is held by the absorber inside the waste liquid holding container 9. FIG. 6 corresponds to the cross-sectional diagram illustrated in FIG. 5.

When the waste ink introduced into the waste ink introduction portion 63 reaches an inner bottom face 67*a* of the container unit 11, the waste ink spreads within a first layer 61A of the first absorber 61. The first absorber 61 is disposed to be in contact with the inner bottom face 67*a*. The first layer 61A is located at the lowest part of the first absorber 61 in a vertical direction (the first lamination direction), in a use state of the recording apparatus 20. The ink is absorbed while spreading horizontally in the inside of the first layer 61A, Since the first layer 61A is compressed in the vertical direction (the first lamination direction) by the rib 72, the ink is also absorbed by a second layer 61B located above the first layer 61A due to the capillary force of fiber, Note that, due to the action of gravity, an ink amount to be absorbed by the first layer 61A is greater than an ink amount to be absorbed by the second layer 61B, As indicated by hatched lines in FIG. 6, the ink in the first absorber 61 inside the waste liquid holding container 9 is absorbed to spread in a convex shape. In other words, the closer the ink region is to the waste ink introduction portion 63, the higher the ink region is in the first lamination direction from the inner bottom face 67*a*.

Figure 7:
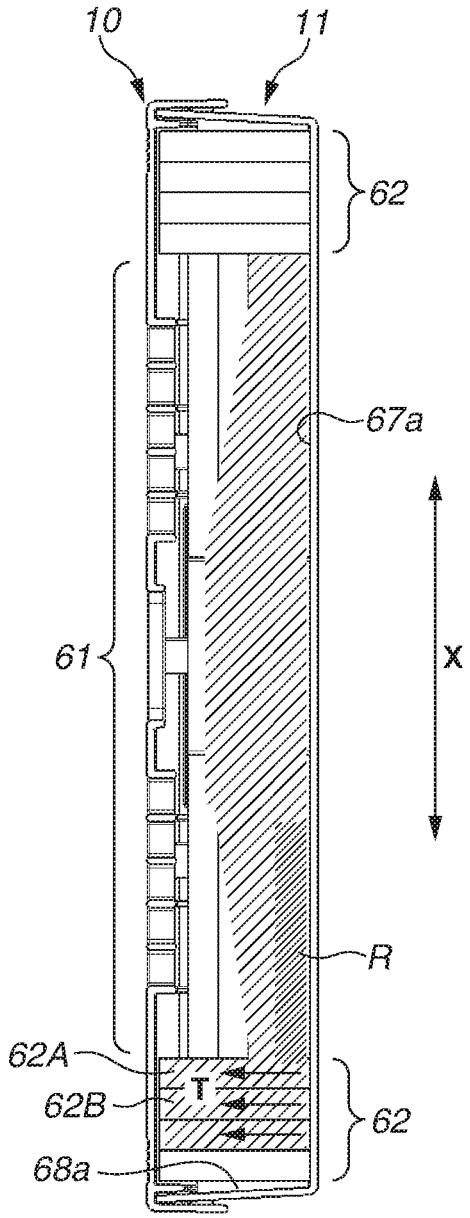
FIG. 7 is a cross-sectional diagram illustrating a flow of ink inside the waste liquid holding container when the waste liquid holding container is vertically tilted.

In the use state of the recording apparatus 20 illustrated in FIG. 6, the length in the longitudinal direction X of the first absorber 61 is sufficiently large with respect to the height thereof. Thus, almost no ink is absorbed by the second absorber 62 disposed at both ends of the first absorber 61 in the longitudinal direction X. This is also because a contact surface with the first absorber 61 is the front surface, not a cutting surface of the second absorber 62, and the absorbency of the front surface is lower than that of the cutting surface. In other words, in a normal use state of the recording apparatus 20, the ink is not easily absorbed by the second absorber 62 while the ink is being held by the first absorber 61, Therefore, in the present example embodiment, the waste liquid holding container 9 needs to be replaced at the timing that the first absorber 61 is filled with the ink. When the waste liquid holding container 9 holding the ink is removed from the recording apparatus 20, e.g., in a case where the waste liquid holding container 9 is replaced with a new waste liquid holding container, the waste liquid holding container 9 may be vertically tilted by the user so that the longitudinal direction X extends vertically, A flow of the ink inside the waste liquid holding container 9 when thus vertically tilted will be described with reference to FIG. 7. FIG. 7 is a cross-sectional diagram illustrating a flow of the ink inside the waste liquid holding container 9 when the waste liquid holding container 9, which has absorbed the ink as illustrated in FIG. 6, is vertically tilted so that the longitudinal direction X extends vertically. FIG. 7 corresponds to the cross-sectional diagram illustrated in FIG. 5.

In general, an absorber made of a material such as felt holds ink by utilizing a strong capillary action of fiber. When the absorber is vertically tilted, a balance with gravity s lost, and the ink held in the absorber falls due to gravity in some cases. As a result, an upper portion of the absorber holds a smaller amount of ink. In other words, in the absorber, a proportion of ink to the amount of ink to be held (a retention rate of ink) varies with height from the inner bottom face 67*a*, and thus a lower portion of the absorber in the direction of gravity has a higher retention rate of ink.

In a case where the waste liquid holding container 9 is vertically tilted as illustrated in FIG. 7, the ink held by the first layer 61A (see FIG. 5) of the first absorber 61 falls due to gravity, A lower portion of the first layer 61A holds a larger amount of ink, as indicated by a densely shaded area R in FIG. 7. The ink exceeding an amount that can be held by the first layer 61A (an acceptable amount) moves to lower part of the first layer 61A due to gravity. In other words, the ink that cannot be held by the first layer 61A seeps downward from the cutting surface of the first layer 61A. Such an overflow of the ink exceeding the acceptable amount moves downward along the bottom face 67*a* of the container unit 11. Since the second absorber 62 is in contact with the bottom face 67*a* of the container unit 11 without creating clearance, the overflow of the ink is absorbed by a first layer 62A of the second absorber 62. The first layer 62A is adjacent to the first absorber 61. The overflow of the ink from the first absorber 61 is thereby prevented from moving on the bottom face 67*a* in the container unit 11 to an inner side face 68*a* that forms a bottom in FIG. 7.

The ink absorbed by the first layer 62A of the second absorber 62 spreads in an arrow T direction due to the property of the absorber. After the ink spreads to some extent, the ink moves to a second layer 62B below the first layer 62A to be held by the second layer 62B. The ink then farther moves sequentially to a lower layer to be held by the lower layer. Due to the property of the absorber, a movement of a liquid easily occurs on a cutting surface, whereas a movement of a liquid does not easily occur on a front surface. Therefore, much of the overflow of the ink moving downward from the cutting surface of the first absorber 61 is absorbed from a cutting surface of the first layer 62A of the second absorber 62, upon moving on the bottom face 67*a* of the container unit 11, The first layer 62A and the second layer 62B located below the first layer 62A are in contact with each other with the respective front surfaces touching each other. Since a movement of a liquid does not easily occur on a front surface, the ink absorbed by the first layer 62A spreads in the arrow T direction. The overflow of the ink, which exceeds an amount that can be held by the first layer 62A, seeps from the cutting surface of the first layer 62A, and moves on the inner bottom face 67*a* and the back surface 13 of the cover unit 10, and is absorbed from a cutting surface of the second layer 62B. As a result, even in a case where the waste liquid holding container 9 is vertically tilted so that the longitudinal direction X extends vertically, the second absorber 62 prevents the ink from directly reaching the inner side face 68*a*. Therefore, leakage of the ink to the outside of the waste liquid holding container 9 can be inhibited for a predetermined time.

In a case where the second absorber 62 is laminated in the same direction as that of the first absorber 61, the cutting surface of the second absorber 62 faces downward when the waste liquid holding container 9 is vertically tilted, Therefore, the overflow of the ink from the cutting surface easily reaches the inner side face 68*a*. This increases the possibility of leakage of the ink from the waste liquid holding container 9. In the present example embodiment, the lamination is provided to prevent the cutting surface of the second absorber 62 from facing downward in a case where the waste liquid holding container 9 is vertically tilted. Thus, the ink holding power of the waste liquid holding container 9 can be increased.

In the present example embodiment, in a case where the waste liquid holding container 9 is vertically tilted, so that the transverse direction Y of the waste liquid holding container 9 extends vertically, a height difference of the first absorber 61 (the length of the transverse direction Y) is small. Thus, the ink can be held in the first absorber 61, and leakage of the ink to the outside does not easily occur. Hence, the second absorber 62 is not disposed at both ends of the first absorber 61 in the transverse direction Y of the waste liquid holding container 9. However, in a case where the length of the first absorber 61 in the transverse direction Y of the waste liquid holding container 9 is long, the second absorber 62 may be provided at both ends of the first absorber 61 in the transverse direction Y of the first absorber 61. In the present example embodiment, the second absorber 62 is disposed between the first absorber 61 and the side face portion 68 of the container unit 11 to be in contact with each of the first absorber 61 and the side face portion 68 without creating clearance. However, clearance may be provided with respect to each of the first absorber 61 and the side face portion 68, if the overflowing ink from the first absorber 61 can be held.

As described above, according to the waste liquid holding container of the present example embodiment, even in a case where the waste liquid holding container is vertically tilted, the ink seeping from the first absorber can be held by the second absorber. Therefore, leakage of the ink to the outside of the waste liquid holding container can be inhibited. It is therefore unnecessary to provide a sealing member that inhibits leakage of the ink, in clearance between the container unit and the cover unit, so that the waste liquid holding container can be provided at low cost. In addition, it is not necessary to increase the size of the first absorber to inhibit leakage by increasing the amount of ink to be held, and therefore downsizing of the waste liquid holding container can be realized.

According to the example embodiment of the disclosure, even in a state where the liquid holding container is tilted, leakage of a liquid from inside can be inhibited.

While the disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-014555, filed Jan. 31, 2018, which is hereby incorporated by reference herein in its entirety.

What is claimed is:

1. A liquid holding container comprising:

a top face portion having an opening portion;

a bottom face portion facing the top face portion;

a first ink absorber being disposed near the opening portion and layered in a first direction from the bottom face portion to the top face portion, the first ink absorber being configured to absorb a liquid introduced from the opening portion; and, a second ink absorber being disposed outside the first absorber in a second direction that intersects the first direction and layered in the second direction, the second ink absorber being configured to absorb the liquid moving from the first ink absorber.

2. The liquid holding container according to claim 1, wherein the first absorber is formed to have a rectangular shape as viewed from the first direction and is made of laminated plurality of sheet members, and the second absorber is disposed next to the first absorber in a longitudinal direction of the first absorber.

3. The liquid holding container according to claim 1, wherein the first absorber and the second absorber are disposed to be in contact with the bottom face portion.

4. The liquid holding container according to claim 3, wherein the second absorber is disposed to be in contact with the top face portion.

5. The liquid holding container according to claim 3, wherein the second absorber is made of one sheet member folded to have a bellows-like shape.

6. The liquid holding container according to claim 1, wherein the first absorber is disposed apart from the top face portion.

7. The liquid holding container according to claim 6, wherein a rib is provided on a surface facing the absorber of the top face portion, and the rib protrudes toward the bottom face portion and abuts the first absorber.

8. The liquid holding container according to claim 6, wherein a hole portion is formed in an area facing the first absorber of the top face portion, and the hole portion exposes a front surface of the first absorber to outside.

9. The liquid holding container according to claim 1, wherein the first absorber and the second absorber are each shaped like a sheet.

10. The liquid holding container according to claim 9, wherein a through opening is formed in the first absorber, and the through opening connects with the opening portion by passing through the first absorber in the first direction.

11. A recording apparatus comprising:

a recording head configured to record an image;

a cap configured to cap the recording head;

a suction unit connected to the cap, and configured to suck a liquid from the recording head in a state where the recording head is capped by the cap; and a liquid holding container configured to hold the liquid sucked by the suction unit, wherein the liquid holding container includes a top face portion, a bottom face portion facing the top face portion, an opening portion provided in the top face portion to introduce a liquid into inside, a first absorber disposed near the opening portion and layered in a first direction from the bottom face portion to the top face portion, and a second absorber disposed outside the first absorber in a second direction that intersects the first direction and layered in the second direction.

12. A liquid holding container configured to absorb a liquid, the liquid holding container comprising:

a bottom face portion;

a first absorber having a first surface and a second surface on which absorbency of the liquid is higher than on the first surface, the first absorber being disposed to have the first surface and the bottom face portion being in contact with each other and to have the second surface and the bottom face portion being not in contact with each other; and a second absorber having a third surface and a fourth surface on which absorbency of the liquid is higher than on the third surface, the second absorber being disposed outside the first absorber to have the fourth surface and the bottom face portion being in contact with each other and to have the third surface and the bottom face portion being not in contact with each other.

13. The liquid holding container according to claim 12, wherein the bottom face portion is disposed to have a rectangular shape, and the second absorber is disposed next to the first absorber in a longitudinal direction of the bottom face portion.

* * * * *